US008464379B1

(12) United States Patent
Zajac

(10) Patent No.: US 8,464,379 B1
(45) Date of Patent: Jun. 18, 2013

(54) STRETCHER SHADE

(71) Applicant: Susan Zajac, Cheektowaga, NY (US)

(72) Inventor: Susan Zajac, Cheektowaga, NY (US)

( * ) Notice: Subject to any disclaimer, the term of this patent is extended or adjusted under 35 U.S.C. 154(b) by 0 days.

(21) Appl. No.: 13/661,343

(22) Filed: Oct. 26, 2012

(51) Int. Cl.
*A61G 1/04* (2006.01)
*A47C 29/00* (2006.01)

(52) U.S. Cl.
USPC ..... 5/629; 5/414; 5/113

(58) Field of Classification Search
USPC ... 5/629, 625, 414–416, 113; 135/96; 296/20; 297/184.15, 184.17
See application file for complete search history.

(56) References Cited

U.S. PATENT DOCUMENTS

| | | | | |
|---|---|---|---|---|
| 1,483,607 | A * | 2/1924 | Liedtke | 296/20 |
| 1,702,010 | A * | 2/1929 | Klever | 296/20 |
| 4,093,305 | A * | 6/1978 | Staroste et al. | 297/184.17 |
| D280,573 | S | 9/1985 | Barton | |
| 5,320,405 | A | 6/1994 | Foster et al. | |
| 5,511,259 | A * | 4/1996 | Tarara | 5/414 |
| 5,551,745 | A * | 9/1996 | Huang | 296/111 |
| 5,690,134 | A | 11/1997 | McCauley | |
| 6,076,206 | A * | 6/2000 | Celaya | 5/414 |
| 6,478,038 | B1 | 11/2002 | Le Gette et al. | |
| 7,347,217 | B2 | 3/2008 | Bree et al. | |
| D598,229 | S | 8/2009 | Allen | |
| 7,963,596 | B2 | 6/2011 | Efthimiou | |

* cited by examiner

*Primary Examiner* — Robert G Santos

(57) ABSTRACT

The present invention features a stretcher shade system for patient protection during transition on stretcher. The shade is collapsible with a plurality of shade supporting frames pivotably connected together. The shade has a plurality of mounting clips to enable the shade removably mounted on any desired place on stretcher pole. The shade provides a convenience, secure and privacy protection for the patient, thus increase the functionality of the stretcher.

6 Claims, 3 Drawing Sheets

(In-use View)

(Front View)

(Exploded View)

(Side View)

(Side Closed View)

STRETCHER SHADE

FIELD OF THE INVENTION

The present invention related to a collapsible shade, and more particularly to a collapsible shade used for stretcher.

BACKGROUND OF THE INVENTION

A stretcher is a medical device used for short-term carrying of patients who require medical care. Stretchers are primarily used in acute out-of-hospital care situations by EMS, military, and Search and rescue personnel. Most stretchers have two parallel arms and fabrics for the patient to lay down. Some stretchers also comprises secure belt used to securely tie the patient on the stretches. However, in some certain areas, such as longer transportation time needed and patients in need of protection from bad weather or severe ambient environment, additional protection are necessary.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a stretcher with a protection shade for patient protection during transition. The shade is collapsible with a plurality of shade supporting arms pivotably connected together. The shade has a plurality of mounting clips to enable the shade removably mounted on any desired place on stretcher poles. The shade provides a convenience, secure and privacy protection for the patient, thus increase the functionality of the stretcher.

DESCRIPTION OF PREFERRED EMBODIMENTS

Figure 1:
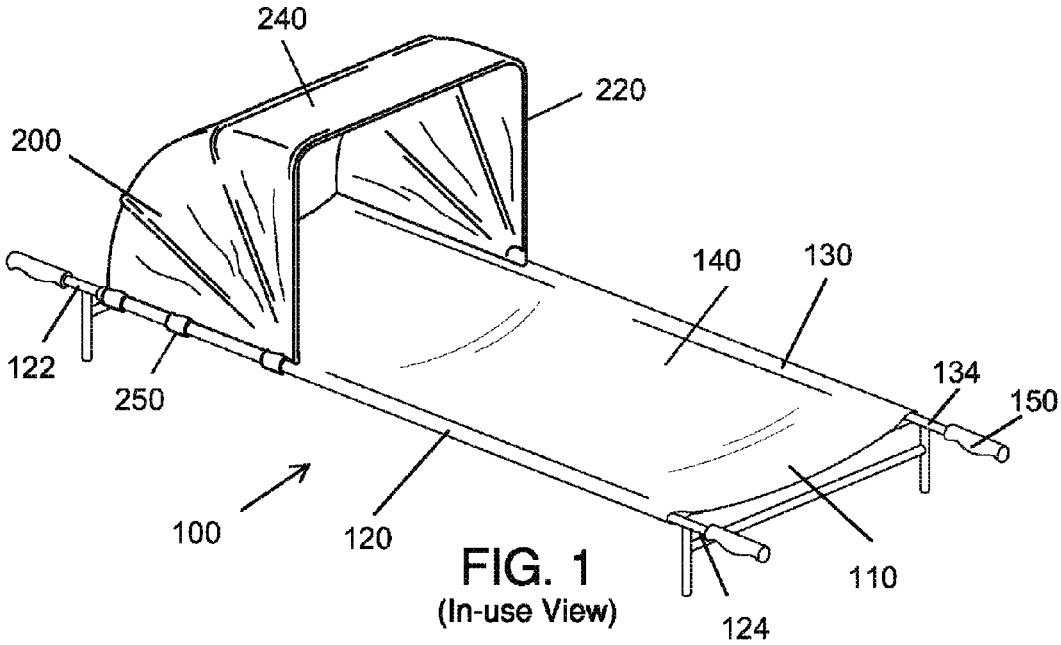
FIG. 1 shows an in-use view of a stretcher with a shade opened.
Figure 2:
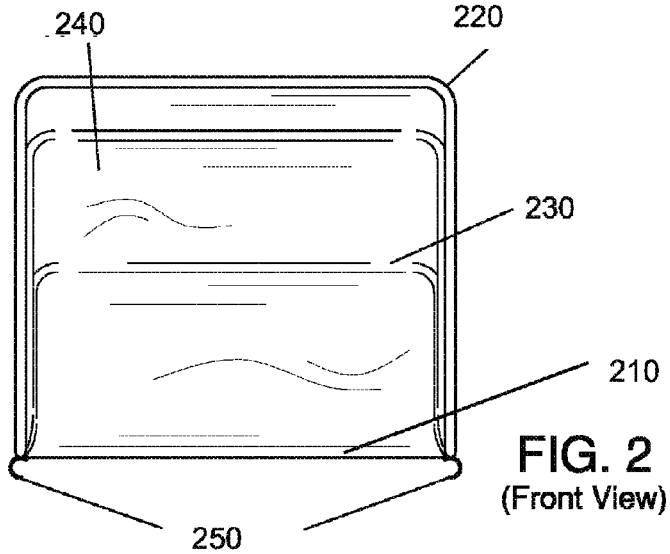
FIG. 2 shows a front view of the shade.
Figure 3:
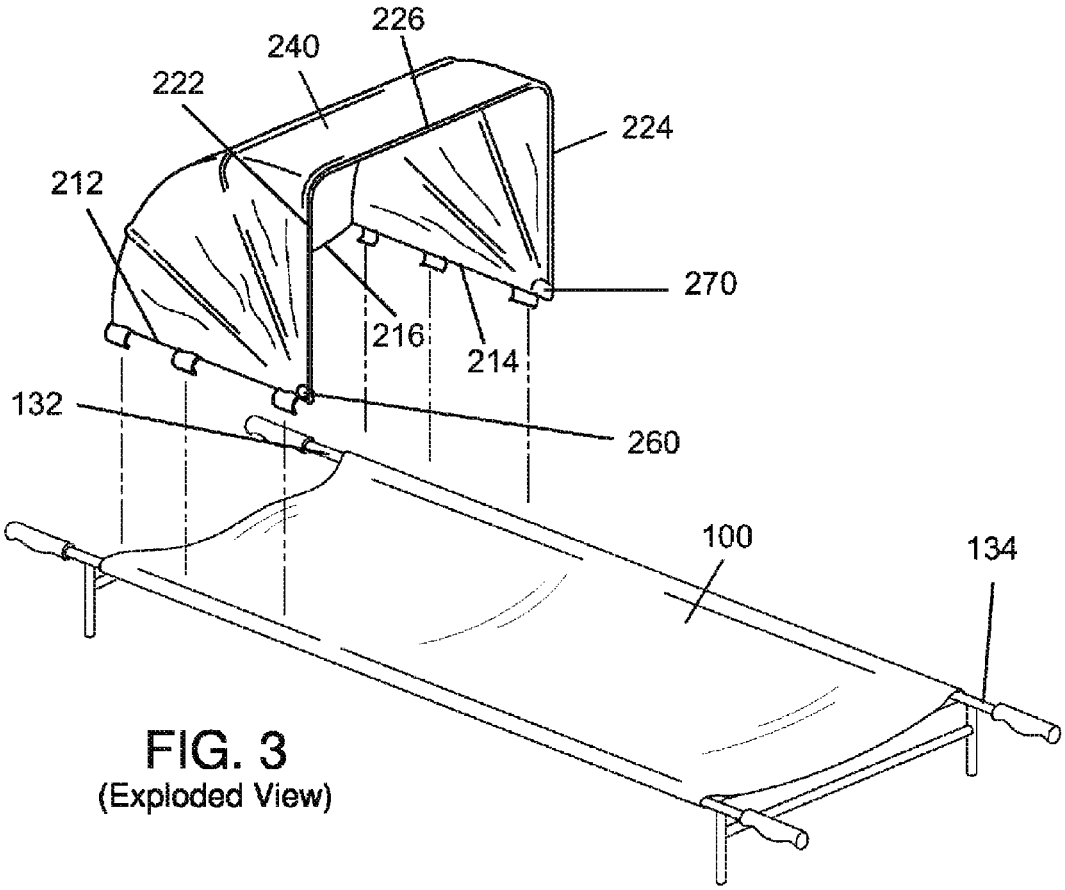
FIG. 3 shows an exploded view of a stretcher with a shade opened.
Figure 4:
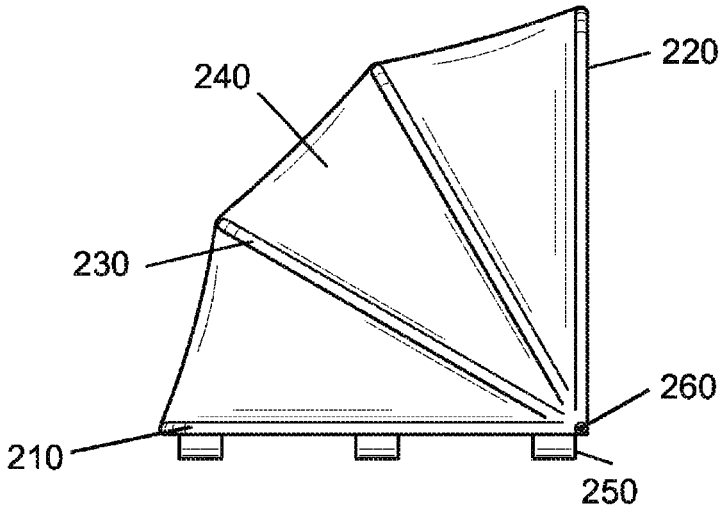
FIG. 4 shows a side view of the shade.
Figure 5:
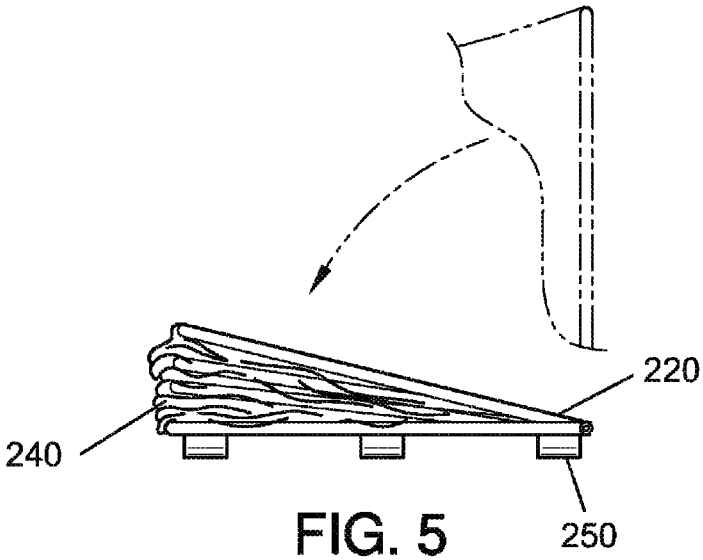
FIG. 5 shows a closed side view of the shade.

Referring now to FIG. 1-5, the present invention features a stretcher shade system (100) for patient protection during transition on stretcher. The system comprises a stretcher (110) and a collapsible shade (200). The shade (200) is collapsible with a plurality of shade supporting frames pivotably connected together. The shade has a plurality of mounting clips to enable the shade removably mounted on any desired place on stretcher poles. The shade provides a convenience, secure and privacy protection for the patient, thus increases the functionality of the stretcher.

The stretcher (110) has a first pole (120), a second pole (130) and a support layer (140), wherein the poles are parallel to each other, wherein the poles are cylindrical shape, wherein the first pole has a first end (122) and second end (124), wherein the pole has a first end (132) and second end (134), wherein the first pole (120) and second pole (130) is covered by a support layer (140), wherein the support layer (140) is disposed between the first pole and second pole, wherein a handle (150) is disposed on both ends of both poles.

The collapsible shade (200) comprises a first frame (210), a second frame (220), and a cover (240).

The first frame (210) has a first end and a second end, wherein the first end of the first frame is operatively connected to the first pivot joint (260) and the second end of the first frame is operatively connected to the second pivot joint (270), wherein the first frame (210) has a U-shape profile with a first end arm (212), a second end arm (214) and a center arm (216), wherein the first end arm (212) is parallel to the second end arm (214), wherein the center arm (216) is perpendicular to the first end arm (212) and second end arm (216).

The second frame (220) having a first end and a second end, wherein the first end of the second frame is operatively connected to the first pivot joint (260) and the second end of the second frame is operatively connected to the second pivot joint (270), wherein the second frame (220) has a U-shape profile with a first end arm (222), a second end arm (224) and a center arm (226), wherein the first end arm (222) is parallel to the second end arm (224), wherein the center arm (226) is perpendicular to the first end arm (222) and second end arm (226).

The cover (240) is attached to the first frame (210) and to the second frame (220). The cover (240) can move between an extended position wherein the cover component is fanned over stretcher (100) and a storage position wherein the cover component is collapsed atop the first frame (210).

A plurality of security means (250) disposed along the first arm (212) and second arm (214) of the first frame (210), wherein the security means (250) enables the first arm (212) and second arm (214) of the first frame (210) securely and removably attached to the first pole (120) and second pole (130) respectively.

In some embodiments, the shade (200) further comprises at least one frame (230) disposed in between the first frame (220) and the second frame (220). In some embodiments, the shade (200) further comprises two frames (230) disposed in between the first frame (220) and the second frame (220). In some embodiments, the shade (200) further comprises three or more frames (230) disposed in between the first frame (220) and the second frame (220).

In some embodiments, the security means (250) are arc shaped mounting clips, wherein the clips securely clap the the first arm (212) and second arm (214) of the first frame (210) to the stretcher (110). In some embodiments, the clap is made of hard plastics. The clap needs to be pushed to tightly "bite" the poles of the stretcher. The claps attachment method does not require any additional assembling parts or procedures, thus saves precious time in patient transportation. The claps attachment method also provides a flexibility that the shade can be placed any position between the first end and second end of the stretch poles.

In some embodiments, the shade can expand up to 90 degrees. In some embodiments, the shade can expand up to 120 degrees. In some embodiments, the shade can expand up to 180 degrees to fully cover the patient and a plurality of mounting clips are also disposed along the first arm (222) and second arm (224) of the second frame (220).

In some embodiments, the cover component (240) is a cloth, a tarp, or fabrics. In some embodiments, the cover component (240) is water resistant for protection in raining weather. In some embodiments, the cover component (240) is breathable such that the patient can breathe freely under the circumstance that the shade expands 180 degree to fully cover the patient. In some embodiments, the cover component (240) is transparent so that the rescue or medical people can see the situation of the patient.

As used herein, the term "about" refers to plus or minus 10% of the referenced number. For example, about 90 degrees refers to degrees between 89 degrees and 99 degrees.

The disclosures of the following U.S. Patents are incorporated in their entirety by reference herein: U.S. Pat. No. 5,690,134, U.S. Pat. No. 6,478,038, U.S. Pat. No. 7,347,217, U.S. Pat. No. 7,963,596. U.S. Pat. No. D280,573, U.S. Pat. No. D598,229 and U.S. Pat. No. 5,320,405.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A stretcher shade system (100) for patient protection during transition on a stretcher, the system comprising:

(a) a stretcher (110) having a first pole (120), a second pole (130) and a support layer (140), wherein the poles are parallel to each other, wherein the poles are cylindrical shape, wherein the first pole has a first end (122) and second end (124), wherein the second pole has a first end (132) and second end (134), wherein the first pole (120) and second pole (130) is covered by a support layer (140), wherein the support layer (140) is disposed between the first pole and second pole, wherein a handle (150) is disposed on both ends of both poles;

(b) a collapsible shade (200), wherein the shade comprises:

(i) a first frame (210) having a first end and a second end, wherein the first end of the first frame is operatively connected to a first pivot joint (260) and the second end of the first frame is operatively connected to a second pivot joint (270), wherein the first frame (210) has a U-shape profile with a first end arm (212), a second end arm (214) and a center arm (216), wherein the first end arm (212) is parallel to the second end arm (214), wherein the center arm (216) is perpendicular to the first end arm (212) and second end arm (216);

(ii) a second frame (220) having a first end and a second end, wherein the first end of the second frame is operatively connected to the first pivot joint (260) and the second end of the second frame is operatively connected to the second pivot joint (270), wherein the second frame (220) has a U-shape profile with a first end arm (222), a second end arm (224) and a center arm (226), wherein the first end arm (222) is parallel to the second end arm (224), wherein the center arm (226) is perpendicular to the first end arm (222) and second end arm (226);

(iii) a cover component (240) attached to the first frame (210) and to the second frame (220), wherein the cover component (240) can move between an extended position wherein the cover component is fanned over the stretcher (100) and a storage position wherein the cover component is collapsed atop the first frame (210); and (iv) three detachable security means (250) disposed along the first arm (212) and three detachable security means (250) disposed along the second arm (214) of the first frame (210), wherein the security means (250) enables the first arm (212) and second arm (214) of the first frame (210) to be securely and removably attached to the first pole (120) and second pole (130) respectively such that the shade (200) is slideable to any position between the first ends and second ends of the stretch poles.

2. The system of claim 1, wherein the shade (200) further comprises at least one frame (230) disposed in between the first frame (220) and the second frame (220).

3. The system of claim 1, wherein the cover component (240) is a cloth, a tarp, or fabrics.

4. The system of claim 1, wherein the cover component (240) is water resistant.

5. The system of claim 1, wherein the cover component (240) is breathable.

6. A stretcher shade system (100) for patient protection during transition on a stretcher, the system consisting of:

(c) a stretcher (110) having a first pole (120), a second pole (130) and a support layer (140), wherein the poles are parallel to each other, wherein the poles are cylindrical shape, wherein the first pole has a first end (122) and second end (124), wherein the second pole has a first end (132) and second end (134), wherein the first pole (120) and second pole (130) is covered by a support layer (140), wherein the support layer (140) is disposed between the first pole and second pole, wherein a handle (150) is disposed on both ends of both poles;

(d) a collapsible shade (200), wherein the shade comprises:

(v) a first frame (210) having a first end and a second end, wherein the first end of the first frame is operatively connected to a first pivot joint (260) and the second end of the first frame is operatively connected to a second pivot joint (270), wherein the first frame (210) has a U-shape profile with a first end arm (212), a second end arm (214) and a center arm (216), wherein the first end arm (212) is parallel to the second end arm (214), wherein the center arm (216) is perpendicular to the first end arm (212) and second end arm (216);

(vi) a second frame (220) having a first end and a second end, wherein the first end of the second frame is operatively connected to the first pivot joint (260) and the second end of the second frame is operatively connected to the second pivot joint (270), wherein the second frame (220) has a U-shape profile with a first end arm (222), a second end arm (224) and a center arm (226), wherein the first end arm (222) is parallel to the second end arm (224), wherein the center arm (226) is perpendicular to the first end arm (222) and second end arm (226);

(vii) a cover component (240) attached to the first frame (210) and to the second frame (220), wherein the cover component (240) can move between an extended position wherein the cover component is fanned over the stretcher (100) and a storage position wherein the cover component is collapsed atop the first frame (210); and (viii) three detachable security means (250) disposed along the first arm (212) and three detachable security means (250) disposed along the second arm (214) of the first frame (210), wherein the security means (250) enables the first arm (212) and second arm (214) of the first frame (210) to be securely and removably attached to the first pole (120) and second pole (130) respectively such that the shade (200) is slideable to any position between the first ends and second ends of the stretch poles.

* * * * *